United States Patent [19]

Cherbuy et al.

[11] Patent Number: 4,610,527

[45] Date of Patent: Sep. 9, 1986

[54] APPARATUS FOR DEVELOPING LATENT MAGNETIC IMAGES

[75] Inventors: Bernard Cherbuy, Belfort; Jean Magnenet, Chaux, both of France

[73] Assignee: Cii Honeywell Bull (Societe Anonyme), Paris, France

[21] Appl. No.: 662,909

[22] Filed: Oct. 19, 1984

[30] Foreign Application Priority Data

Nov. 17, 1983 [FR] France ..... 83 18282

[51] Int. Cl.[4] ..... G03G 19/00

[52] U.S. Cl. ..... 355/3 DD; 118/657; 118/658

[58] Field of Search ..... 355/3 DD, 14 D; 118/656, 657, 658; 29/DIG. 28

[56] References Cited

U.S. PATENT DOCUMENTS 3,804,511 4/1974 Rait et al. ..... 355/3 DD

FOREIGN PATENT DOCUMENTS 2098096 11/1982 United Kingdom ..... 355/3 DD

*Primary Examiner*—Arthur T. Grimley
*Assistant Examiner*—David Warren
*Attorney, Agent, or Firm*—Kerkam, Stowell, Kondracki & Clarke

[57] ABSTRACT

The invention relates to an apparatus for developing latent magnetic images used for example in magnetic printing machines. This apparatus includes a retouching device (20) comprising, first, a transport roller (27) which is displaced in the direction opposite that of the magnetic recording surface (13) in proximity with which it is placed and, second, a magnet (31) disposed in the interior of the roller (27) in such a manner that facing this surface it has a pole (32) the polarity of which is opposite that of the magnetized zones (14) of this surface, the magnetic axis (N'S') of this magnet being inclined in the opposite direction from that of the displacement of the surface (13).

23 Claims, 4 Drawing Figures

APPARATUS FOR DEVELOPING LATENT MAGNETIC IMAGES

FIELD OF THE INVENTION

The present invention relates to an apparatus for developing latent magnetic images on a magnetic recording surface and more particularly to a retouching device intended to eliminate excess particles of a developer or toner which have been deposited on the magnetic recording surface of the apparatus. A retouching or touch-up device of this kind is applicable particularly to magnetic printing machines.

BACKGROUND OF THE INVENTION

In modern equipment used for information processing, rapid printers in which printing of the characters is accomplished without causing relief-printing type to strike a sheet of receptive paper are being used more and more. These printing machines, known as non-impact printers, generally include a recording medium, most frequently comprising a rotating drum or an endless belt, which is provided with a recording surface on which sensitized zones corresponding to characters to be printed can be created by electrostatic or magnetic means, these zones being capable of attracting the solid particles of a powdered developer product.

Various applicator devices can be used for applying the solid developer particles to the recording carrier of a printing machine of this type. For example, the device which is described and shown in U.S. Pat. No. 3,161,544 may be utilized. However, despite all the care taken in realizing this device, it is difficult to prevent the developer particles from being deposited not only to excess on the sensitized zones of the recording medium but also, although in very slight quantity, outside these zones. This phenomenon has been attributed to the fact that if the particles are charged with humidity or static electricity, or if they undergo melting, which, however slight, makes them more or less sticky, they adhere to the surface with which they have been placed in contact. An excessive deposit of developer particles on the sensitized zones of the recording medium is undesirable because when this developer is transferred to the sheet of receptive paper, there is a risk that the developer that has been deposited in accordance with the configuration of the image formed by these sensitized zones may smudge and blur the image. On the other hand, the deposit of particles outside the sensitized zones of the recording medium is also undesirable, because when these particles are transferred to the paper they form a base which reduces the contrast between the transferred image and the original base of the paper.

In the prior art, various retouching devices have been used to eliminate excess developer on the surface of the recording medium. One example of a device of this kind has been particularly described in U.S. Pat. No. 3,816,799, in which a mass of developer particles, placed in contact with the surface of the recording medium and downstream of a device for applying the particles, discharges the particles which adhere to the recording medium outside the sensitized zones, such that these discharged particles become detached from the recording medium and clump together with this mass. In any event a retouching device of this kind is not completely satisfactory in use, because it does not always assure a complete electrical discharge of the particles and as a consequence does not enable the reliable elimination of the developer particles which remain on the recording medium outside the sensitized zones.

Another known retouching device is described in U.S. Pat. No. 3,643,629 and includes a magnetic assembly rotating in the interior of a fixed cylindrical sleeve. The assembly itself is embodied by a plurality of magnetic elements, in the form of a sector, disposed side by side about a rotating shaft. These elements are magnetized in such a way as to have peripheral magnetized zones on their peripheral surface, the magnetic polarity of which remains constant along a direction parallel to the shaft, but alternating in passing from one peripheral zone to the next. Nevertheless, with this retouching device in which the magnetic element accommodated in the interior of the fixed sleeve rotated past the recording medium in the opposite direction from that in which the medium is displaced, uniform removal of the excess particles is not obtained, because in certain parts of the medium the removal is too pronounced and in other parts it is insufficient.

This disadvantage can be overcome by using the retouching device described in U.S. Pat. No. 4,067,018, which enables the elimination of the excess developer particles on an endless magnetic tape on which a latent magnetic image has been produced. This retouching device includes a guide roller of radius R, over which the endless magnetic tape travels. When this tape is driven at a constant speed V, the developer particles located on this tape are subjected as they travel past the guide roller to the action of a centrifugal force, the value of which, for each particle of mass M, is equal to $MV^2/R$. Under these conditions, the intensity of this centrifugal force can be adjusted by suitably selecting the speed at which the tape is driven and the radius of the guide roller such that the value of the centrifugal force is greater than that of the forces retaining the particles on the zones at the base of the tape, yet is not so great as to be able to detach all the particles located on the magnetized zones of this tape. The excess developer particles which have thus been detached from the tape are then eliminated by means of an aspirator disposed near the guide roller.

It has been found that to remove the excess developer particles on this magnetic tape the acceleration imparted by this centrifugal force must be at least equal to 10 g, g being the value of the acceleration of gravity. As a result, in the case where the guide roller used in this retouching device has a diameter of twenty millimeters, the endless magnetic tape must be driven at a speed of at least one meter per second. A displacement speed on this order, however, means that this retouching device cannot be used in modern magnetic printing machines, in which the drive speed of the recording medium in practice does not exceed 30 cm/s. To enable the use of this retouching device in a printing machine of this kind, the diameter of the guide roller must accordingly be reduced, but to do so means that a guide roller must be selected the diameter of which must not exceed two millimeters. A guide roller of that size would necessarily be fragile, and its use in a magnetic printing machine would not offer all the security that is desired.

OBJECT AND SUMMARY OF THE INVENTION

The present invention overcomes the disadvantages of the prior art and proposes an apparatus for developing latent magnetic images which includes a retouching device capable of reliably and uniformly eliminating the excess developer particles located on the recording medium of the apparatus, even if the recording medium is driven at a speed on the order of a few tens of centimeters per second.

More specifically, the present invention relates to an apparatus for developing latent magnetic images which includes a medium driven in a predetermined direction and provided with a magnetic recording surface on which are formed magnetized zones having the same magnetic polarity; an applicator device for applying particles of a powdered magnetic developer to these magnetized zones; and a retouching device for eliminating the excess developer particles which have been deposited on this surface. The retouching device used in the invention comprises:

an endless conveyor element which is driven continuously and is disposed along a location of the path followed by said recording surface, such that its exterior surface travels past this location in immediate proximity therewith;

and a magnetized element in the form of a bar, placed in the interior of this endless conveyor element, in proximity with the location of the path, this magnetized element being oriented in such a manner that its magnetic pole nearest the location is the pole the polarity of which is opposed to that of the magnetized zones, and in such a manner that its magnetic axis is inclined with respect to the straight line which passes through the center of this magnetized element and is normal to the recording surface in said location, in the opposite direction from the direction of displacement of the recording surface, the angle formed by this magnetic axis with this straight line being no larger than than 45°.

The invention will be better understood and further objects and advantages will become more apparent from the ensuing detailed description, given by way of non-limiting example and taken in conjunction with the drawings.

DESCRIPTION OF THE PREFERRED EMBODIMENTS

Figure 1:
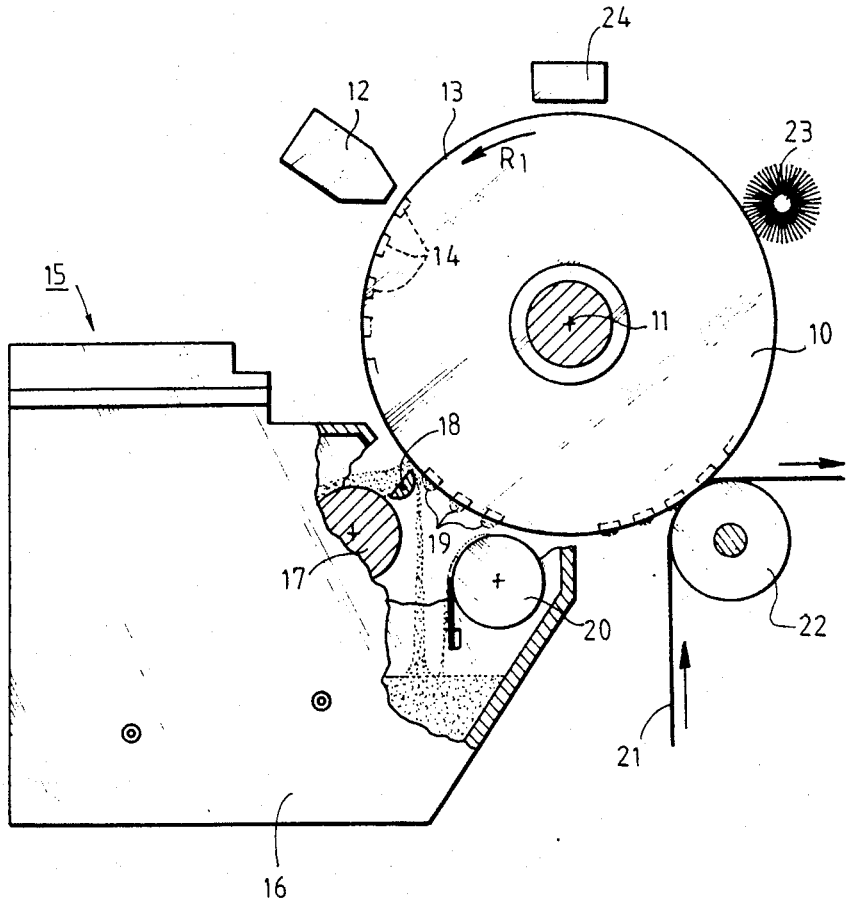
FIG. 1 is a fragmentary schematic view of a magnetic printing machine provided with a retouching device in accordance with the invention.

The printing machine shown in schematic fashion in FIG. 1 includes a magnetic recording medium which in the exemplary embodiment under consideration comprises a magnetic drum 10 mounted on a horizontal shaft 11. The drum is set into rotation in the direction of the arrow R1 by an electric motor (not shown). The recording of data on this drum 10 is accomplished by a magnetic recording device 12 disposed close to the surface of ths drum.

In this exemplary embodiment, this device 12 is embodied by an assembly including a plurality of magnetic recording heads which are disposed one beside the other and aligned parallel to the rotational shaft 11 of the drum. Each of these heads, when it is excited at various intervals by an electric current, generates a variable magnetic field the effect of which is to create magnetized regions or zones 14 on the surface 13 of the drum traveling past the heads. The instants of excitation of these heads are determined in a known manner so as to obtain groups of magnetized zones, that is, latent magnetic images, on this surface 13, the shape of the zones or images corresponding to that of the characters that are to be printed. The magnetized zones 14 of the drum 10 then travel past an applicator device 15 which is disposed beneath the drum 10 and enables the application on the surface 13 of the drum of particles of a powdered developer contained in a reservoir 16.

In the exemplary embodiment shown in FIG. 1, the applicator device 15, in a manner known in the state of the art, includes, first, a rotating magnetic cylinder 17 which picks up developer particles located in reservoir 16 and transfers them in the vicinity of the surface of the drum 10, and, second, a fixed deflector 18 which is disposed between the magnetic cylinder 17 and the drum 10 in order to collect the particles transported by the cylinder 17 and apply them to the surface of the drum.

The developer particles which are thus applied to the drum 10 do not, in principle, adhere anywhere but on the magnetized zones of the drum, such that these zones, after traveling past the applicator device 15, appear to be coated with a layer of developer, forming deposits 19 of particles on the surface 13 of the drum. These deposits 19 then travel past a retouching device 20, to be described in detail below, the role of which is to eliminate the developer particles that have adhered elsewhere than to the magnetized zones 14, as well as those particles which are deposited to excess on these zones. Subsequently, the developer particles which are located on the drum 10 are transferred, virtually in their entirety, to a sheet of paper 21 which is pressed against the drum 10 by a pressure roller 22. The residual particles still remaining on the drum 10 after this transfer has taken place are then removed by a cleaning device 23. The magnetized zones which have traveled past the cleaning device 23 then travel past an erasing device 24, which enables portions of the drum 10 which have thus been demagnetized to be remagnetized when they arrive before the recording device 12.

The powdered developer contained in the reservoir 16 of the printing machine now to be described consists of magnetic particles coated with a resin which when heated is capable of melting and adhering to the sheet of paper 21 on which it has been deposited. This melting is normally brought about by a heating device which traverses the sheet of paper 21 after being passed over the pressure roller 22. However, this heating device is of a known type and is therefore not shown in FIG. 1 because it is not part of the invention.

Figure 2:
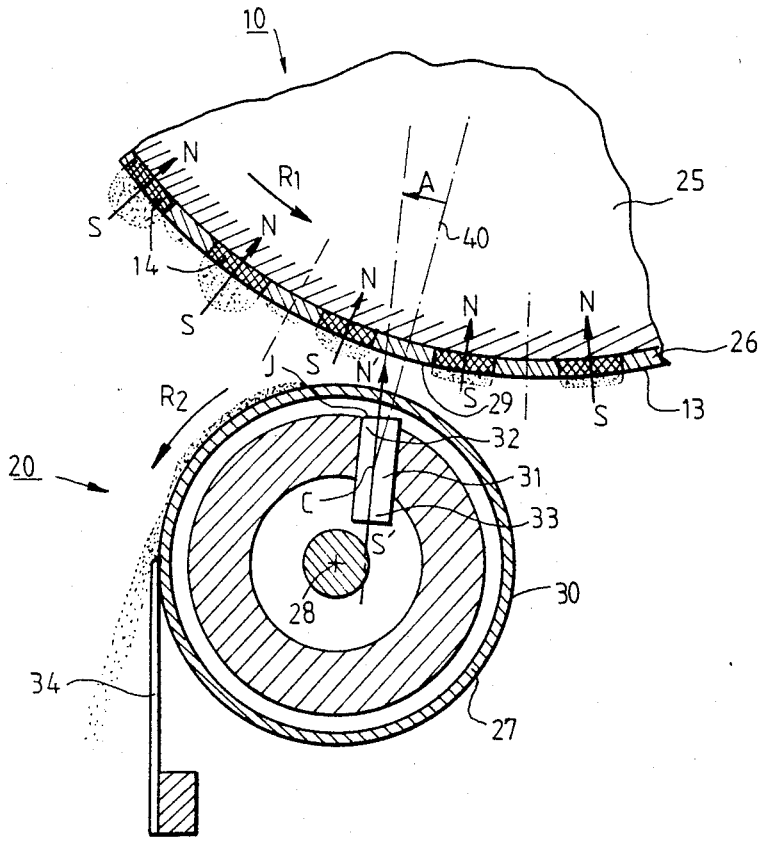
FIG. 2 is a sectional view on a larger scale showing the element comprising the retouching device with which the printing machine shown in FIG. 1 is equipped.

In FIG. 2, a portion of the magnetic drum 10 is shown schematically in section, on a large scale, so that the magnetized zones 14 formed on the surface 13 of this drum have a relatively large apparent size in the drawing. It must be noted that in actuality each of these magnetized zones has a size on the order of 100 to 200 microns, or in other words has a square section by way of example on the order of 100 to 200 microns on a side. Furthermore, for obvious reasons of clarity in the drawing, the magnetized zones which are shown in FIG. 2 have not been drawn to the scale of the drawing. It should also be noted that the magnetic drum 10, in a manner known in the state of the art, comprises a cylindrical support 25 made of a soft magnetic material of high magnetic permeability (such as iron, or an iron-silicon alloy), this support being coated with a layer 26 of magnetic material of high coercivity, such as the magnetic alloy of nickel and cobalt. This layer 26 is provided so as to be magnetized transversally, the support 25 then acting as a magnetic shunt. Under these conditions, the magnetized zones 14 formed on the magnetic drum 10 by the recording device 12 all have axes of magnetization NS oriented perpendicular to the surface 13 of the drum. The recording device 12 is embodied in a known manner, such that these axes of magnetization are all oriented in the same direction. Thus in the exemplary embodiment shown in FIG. 2, all the magnetized zones 14 have a south magnetic polarity (S) on their exterior face. As further shown by by FIG. 2, these magnetized zones have the same size and exhibit substantially the same intensity of magnetization, as indicated by the lengths of the arrows N, S. In FIG. 2, these magnetized zones 14 are shown as they appear after they have passed the developer particle transfer cylinder 17 in the applicator device 15, or in other words after they have been coated with a layer of developer. It should be noted here that on those magnetized zones 14 which have not yet traveled past the retouching device 20, the thickness of this layer is relatively great, generally on the order of more than one hundred microns, while on the magnetized zones 14 which have traveled past the retouching device the thickness of this layer is reduced to a value which under the conditions to be described in detail below may attain the order of thirty microns.

The retouching device 20 with which the printing machine being described is equipped includes an endless conveyor element 27 which, in the exemplary embodiment shown in FIG. 2, is in the form of a hollow cylinder, the axis of rotation 28 of which is parallel to the axis 11 of the drum 10. This cylinder, which is embodied of some nonmagnetic material, such as aluminum, is disposed at the location 29 of the circular path which is traced by the surface 13 of the drum in the course of the rotation of this drum, this location 29 being located downstream of the point where the developer particles originating in the reservoir 16 are applied to this surface 13. This location extends over a length on the order of one to two centimeters. The cylinder 27, which is set to rotating about its axis 28 in a known manner, is placed quite close to the surface 13 of the drum 10. More precisely, this cylinder 27 is spaced apart from the surface 13 by a distance in practice not exceeding three millimeters. Thus in the exemplary embodiment described, this distance equals 1.5 millimeters. It should also be noted that as shown in FIG. 2, the drum 10 and the cylinder 27 both rotate in the same direction, which in this exemplary embodiment is counterclockwise. Under these conditions, the exterior surface 30 of the cylinder 27 travels past the location 29 of the path in the opposite direction from that of the displacement of the surface 13 of the drum. It is useful to note here that in the example described, this surface 13 is displaced at a linear speed equal to thirty centimeters per second, while the surface 30 of the cyliner 27 is displaced at a linear speed equal to 1.5 millimeters per second.

The retouching device shown in FIG. 2 furthermore includes a magnetized element 31, in the form of a bar, which is accommodated in the interior of the cylinder 27 and is placed in proximity to the location 29 mentioned above. This magnetized element 31, which in the example described here comprises a permanent magnet, has two opposite poles 32 and 33, of which one, 32, has a north magnetic polarity (N′) and the other, 33, has a south magnetic polarity (S′). This permanent magnet 31 is oriented such that its magnetic pole which is closest to the location 29 is the one having the opposite polarity from that of the magnetized zones 14 on their exterior faces. In other words, the direction of magnetization of this magnet 31 is the same as that of the magnetized zones traveling past it. Thus in the exemplary embodiment shown in FIG. 2, in which the magnetized zones 14 have a south magnetic polarity (S) on their exterior faces, the magnetic pole of the magnet 31 that is closest to the location 29 is the one having a north magnetic polarity (N′), or in this case the magnetic pole 32. It should also be noted that the thickness of the cylinder 27 is always very slight, generally being between one millimeter and a few tens of millimeters, and that the end J of this closest magnetic pole is spaced apart from the surface 13 of the drum by a distance D the value of which will be defined below but which in practice is equal to no more than five millimeters. Thus in the example described, the distance D by which the end J of the north magnetic pole 32 is spaced apart from this surface 13 equals 2.5 millimeters. Furthermore, as may be seen in FIG. 2, the magnetic axis N′S′ of the magnet 31 is not oriented in the direction of the straight line 40, which, passing through the center C of the magnet 31, is normal to the path location 29, but instead is inclined with respect to this normal 40 in the direction opposite from that of the displacement of the surface 13 of the drum. This magnetic axis N′S′ then forms an angle A with this normal 40, the size of which depends on the linear speed of displacement of the surface 13 but nevertheless does not exceed 45°. Thus in the example described, where the surface 13 is displaced at a linear speed equal to 30 centimeters per second, this angle A is in practice equal to 35°. In the case where the displacement speed of the surface 13 is on the order of 10 centimeters per second, this angle A is approximately 25°. Similarly, for a linear displacement speed of the surface 13 equal to 5 centimeters per second, the angle A is approximately 15° in size.

Each of the developer particles which have been deposited on the same magnetized zone 14 is attracted by this zone with a force $F_M$ the intensity of which depends not only on the value of the magnetization of this zone but also on the distance h separating this particle from this zone. This magnetic force $F_M$, in the example described, varies as a function of this distance h, in accordance with a law of variation illustrated by the solid-line curve 50 in the diagram of FIG. 4, the coordinates of the points comprising this curve 50 relating to two axes of rectangular coordinates both passing through the same origin O and this origin O corresponding, on the surface 13, to the center of the magnetized zone. Similarly, when this magnetized zone comes to be plumb with the magnet 31 of the retouching device 20, each of the developer particles which have been deposited on this zone is subjected by this magnet 31 to an attractive magnetic force $F_R$ the intensity of which depends not only on the value of the magnetic induction of this magnet but also on the distance d separating this particle from the end J of the magnetic pole 32 of this magnet.

Figure 4:
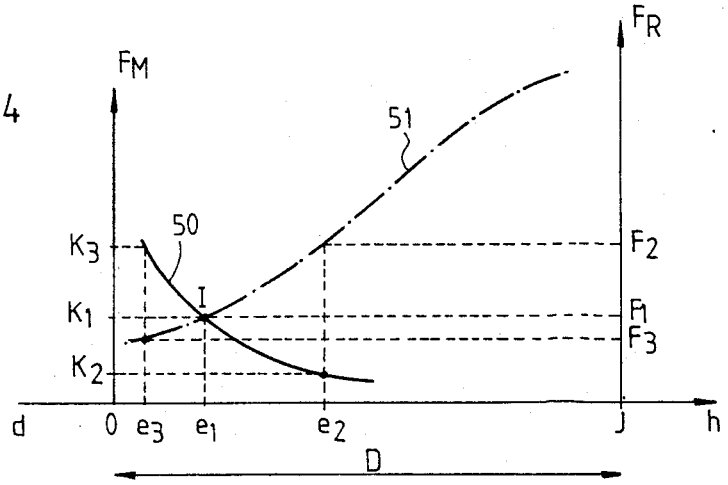
FIG. 4 is a diagram illustrating the manner in which the forces of magnetic attraction exerted upon the developer particles deposited on the recording medium of the printing machine shown in FIG. 1 vary.

In the diagram of FIG. 4, the law of variation of this magnetic force $F_R$ as a function of this distance d has been illustrated by the dot-dash curve 51, the coordinates of the points comprising this curve relating to two axes of rectangular coordinates passing through the point J. When the magnetized zone 14 is located plumb with the magnet 31, that is, at the distance OJ =D of the end J of this magnet, the above-mentioned curves 50 and 51 intersect at a point I the abscissa of which, in terms of the origin O, is labeled $e_1$ in the diagram of FIG. 4. It will be appreciated that under these conditions, for the particles located on this zone 14 at a distance $e_2$ from the surface 13 greater than $e_1$, the magnetic force $F_2$ exerted by the magnet 31 on these particles is greater than the force $K_2$ exerted by this zone on these same particles. As a result, these particles come to be applied against the exterior surface 30 of the cylinder 27. Contrarily, for those particles on this zone 14 which are located at a distance $e_3$ from the surface 13 which is less than the distance $e_1$, the magnetic force $F_3$ exerted by the magnet 31 is less than the force $K_3$ exerted by this zone. As a result, these particles remain applied to the magnetized zone 14. Since the course of the curves 50 and 51 is dictated by the dimensions and magnetization values of the magnetized zones 14 and of the permanent magnet 31, it is then clear that once the forces exerted at different points by this magnet and by each of these zones have been measured experimentally and the corresponding curves 50 and 51 have consequently been plotted, it is possible to determine the value of the distance D by which this magnet 31 must be spaced apart from the surface 13 in order for the abscissa $e_1$ of the point of intersection I of these two curves to be equal to the value of the thickness of the layer of developer which it is desired to maintain on each of these magnetized zones. Thus, in the example described, where each magnetized zone 14 has a size of about 100 microns and where the permanent magnet 31 has a width practically equal to 6 millimeters, it has been found that in order to reduce the thickness of the layer of developer on each of the magnetized zones 14 to approximately 30 microns, this magnet 31 must be spaced apart from the surface 13 of the drum by a distance D which is practically equal to 2.5 millimeters.

It should also be noted that the developer particles located on the surface 13 of the drum outside the magnetized zones 14 are likewise subjected to the attractive action exerted by the magnet 31 at the moment where they pass plumb with this magnet. Because the force of adhesion which keeps these particles applied to this surface 13 is markedly less than that exerted by the magnet 31, these particles become detached from this surface and then come to be applied to the exterior surface 30 of the cylinder 27. The surface 30 of the cylinder 27 on which the particles detached from the drum by the action of the magnet 31 are now applied is not smooth but rather has a certain roughness, the distance between the highest and lowest points on this surface 30 remaining less than 300 microns. As a result of this roughness, the developer particles which have been applied to the surface 30 are moved in the course of the rotation of the cylinder 27. A scraper or squeegee 34 the end of which is pressed against the surface 30 then allows these particles to be removed from the cylinder 27 and to fall back into the reservoir 16, as shown in FIG. 1.

Figure 3:
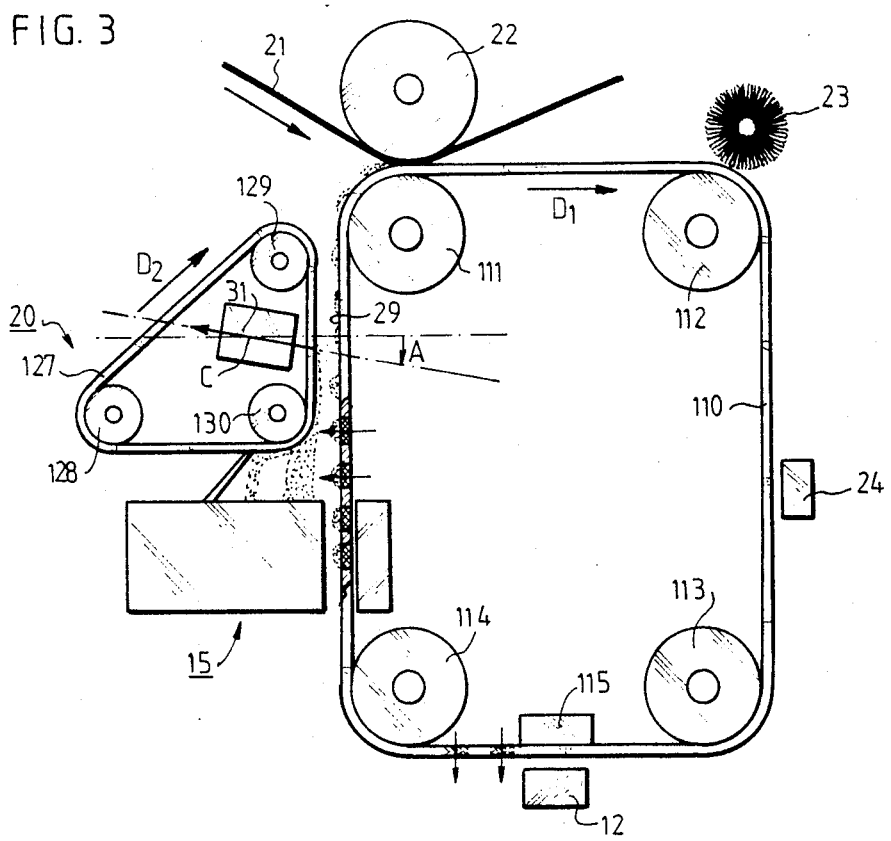
FIG. 3 is a fragmentary schematic view of another form of embodiment of a magnetic printing machine equipped with the retouching device according to the invention.

The retouching device described herein is applicable not only to a printing machine in which the recording medium comprises a magnetic drum but also to a printing machine the recording medium of which, as shown in FIG. 3, comprises an endless magnetic tape 110, held on the rollers 111, 112, 113, 114, the tape being pressed against a magnetic shunt 115 comprising a bar of soft magnetic material of high permeability. The printing machine schematically shown in FIG. 3 includes the same component elements as those in the machine shown in FIG. 1, such as the magnetic recording device 12, the applicator device 15, and so forth. The travel of this tape 110 in the direction indicated by the arrow D1 is assured by an electric motor, not shown, which drives one of the rollers, while the other rollers rotate freely.

The printing machine shown in FIG. 3 may be equipped with the same retouching device as that shown in FIG. 2. However, in another form of embodiment, this retouching device 20, as shown in FIG. 3, includes a conveyor element taking the form of an endless belt 127 held on three rollers 128, 129, 130 and made of a flexible, nonmagnetic material such as rubber. The rollers 129 and 130 are disposed in such a manner that the portion of the belt 127 included between these two rollers is parallel to a location 29 of the path traced by the magnetic tape 110 between the rollers 111 and 114 and is located in immediate proximity with this location 29. The endless belt 127 is driven in a direction indicated by the arrow D2 in FIG. 3 such that the portion of the belt 127 included between the rollers 129 and 130 travels in the opposite direction from that in which the magnetic tape 110 between the rollers 114 and 111 is displaced. The permanent magnet 31 which is disposed in the interior of the path taken by the belt 127 is in proximity with the location 29 and as shown in FIG. 3 is oriented such that its magnetic pole closest to this location 29 is the pole having the opposite polarity from that of the magnetized zones facing the belt 127. As FIG. 3 also shows, the magnetic axis of the magnet 31 is inclined with respect to the normal 40 which, passing through the center C of this magnet, is normal to the surface of the belt 127 adjacent to location 29, the inclination being effected in the opposite direction from that of the displacement of the magnetic tape 110. This magnetic axis then forms an angle A with the straight line 40 the value of which, defined above, depends on the speed of displacement of the magnetic tape 110 but does not exceed 45°.

When the retouching device according to the present invention is used under the conditions described above, it is not only possible to eliminate the particles of developer deposited outside the magnetized zones on the magnetic recording medium, but also to reduce considerably the thickness of the layer of developer on each of these magnetized zones. Thus it has been possible, for instance, on magnetized zones having a size on the order of 100 to 200 microns, to reduce the thickness of the layer of developer deposited on these zones from 100 to 30 microns. Furthermore, the retouching device according to the invention makes it possible for developer particles located on the magnetized zones to regroup toward the center of these zones, which further improves the quality of the printed image obtained when these particles are transferred onto the paper.

It will be understood that the invention is not limited to the forms of embodiment described and shown herein, which have been provided solely by way of example, but also encompasses every means comprising techniques equivalent to those described and shown herein, whether taken in isolation or in combination with one another, and as defined by the scope of the appended claims.

What is claimed is:

1. An apparatus for developing latent magnetic images comprising a recording medium (10) driven in a predetermined direction along a path and provided with a magnetic recording surface (13) on which a plurality of magnetized zones (14) having the same magnetic polarity and intensity are formed; means (15) disposed at a first location along the path for applying powdered magnetic developer particles to the magnetized zones; and a retouching device (20) for removing a portion of the developer particles which have been applied on said recording surface, said retouching device comprising an endless conveyor (27) adapted to be driven continuously and disposed such that an exterior surface (30) of the conveyer is moved into immediate proximity with a second location (29) of the path followed by the recording surface, said second location being downstream of the first location where developer particles are applied to said recording surface; and a magnetized element (31) having a center (C) and magnetic poles defining a magnetic axis (N'S'), said magnetized element being fixedly disposed within said endless conveyer in proximity with said second location and such that its magnetic axis is inclined by an angle (A) less than or equal to 45° with respect to a straight line (40) which passes through said center and is normal to said recording surface at said second location, said magnetic axis being inclined in an upstream direction opposite to the direction of displacement of said recording surface along the path, and said magnetized element being oriented so that one of its magnetic poles which is closest to said second location has a polarity which is opposite to the polarity of said magnetized zones on the recording surface, the magnetized element being adjusted with respect to the recording surface so as to leave extant on each magnetized zone of the recording surface which passes the second location a layer of developer particles having a thickness which is approximately equal to a predetermined value.

2. An apparatus for developing latent magnetic images as defined by claim 1, wherein the magnetized element comprises a permanent magnet.

3. An apparatus for developing latent magnetic images as defined in claim 1, wherein the exterior surface (30) of the endless conveyor (27) travels past said part (29) in the opposite direction from that of the displacement of the magnetic recording surface (13).

4. An apparatus for developing latent magnetic images as defined in claim 1, wherein the recording surface is driven at a linear speed on the order of thirty centimeters per second, and the angle (A) formed by the magnetic axis (N'S') of the magnetized element (31) with the straight line (40) has a value approximately equal to 40°.

5. An apparatus for developing latent magnetic images as defined in claim 1, wherein an end (J) of the magnetic pole of the magnetized element that is closest to the second location (29) is spaced apart from the magnetic recording surface (13) by a distance equal to no more than five millimeters.

6. An apparatus for developing latent magnetic images as defined in claim 5, wherein in that the distance separating the endless conveyor (27) from the magnetic recording surface (13) is equal to no more than three millimeters.

7. An apparatus for developing latent magnetic images as defined in claim 1, wherein endless conveyor element (27) comprises a hollow cylinder made of a nonmagnetic material.

8. An apparatus for developing latent magnetic images as defined in claim 1, wherein the endless conveyor (27) comprises a flexible belt embodied in a nonmagnetic material.

9. An apparatus for developing latent magnetic images as defined in claim 2, wherein the exterior surface (30) of the endless conveyor (27) travels past said second location (29) in the opposite direction from that of the displacement of the magnetic recording surface (13).

10. An apparatus for developing latent magnetic images as defined in claim 2, wherein the recording surface is driven at a linear speed on the order of thirty centimeters per second, and the angle (A) formed by the magnetic axis (N'S') of the magnetized element (31) with the straight line (40) has a value approximately equal to 40°.

11. An apparatus for developing latent magnetic images as defined in claim 3, wherein the recording surface is driven at a linear speed on the order of thirty centimeters per second, and the angle (A) formed by the magnetic axis (N'S') of the magnetized element (31) with the straight line (40) has a value approximately equal to 40°.

12. An apparatus for developing latent magnetic images as defined in claim 2, wherein the endless conveyor (27) comprises a hollow cylinder made of a nonmagnetic material.

13. An apparatus for developing latent magnetic images as defined in claim 3, wherein the endless conveyor (27) comprises a hollow cylinder made of a nonmagnetic material.

14. An apparatus for developing latent magnetic images as defined in claim 4, wherein the endless conveyor (27) comprises a hollow cylinder made of a nonmagnetic material.

15. An apparatus for developing latent magnetic images as defined in claim 5, wherein the endless conveyor (27) comprises a hollow cylinder made of a nonmagnetic material.

16. An apparatus for developing latent magnetic images as defined in claim 6, wherein the endless conveyor (27) comprises a hollow cylinder made of a nonmagnetic material.

17. An apparatus for developing latent magnetic images as defined in claim 2, wherein the endless conveyor (27) comprises a flexible belt embodied in a nonmagnetic material.

18. An apparatus for developing latent magnetic images as defined in claim 3, wherein the endless conveyor (27) comprises a flexible belt embodied in a nonmagnetic material.

19. An apparatus for developing latent magnetic images as defined in claim 4, wherein the endless conveyor element (27) comprises a flexible belt embodied in a nonmagnetic material.

20. An apparatus for developing latent magnetic images as defined in claim 5, wherein the endless conveyor (27) comprises a flexible belt embodied in a nonmagnetic material.

21. An apparatus for developing latent magnetic images as defined in claim 6, wherein the endless conveyor (27) comprises a flexible belt embodied in a nonmagnetic material.

22. An apparatus for developing latent magnetic images as defined in claim 1, wherein said second location is upstream of a third location where developer particles are transferred to a sheet which contacts the recording surface.

23. An apparatus for developing latent magnetic images as defined in claim 1, wherein the magnetized element is disposed with respect to the recording surface such that the force exerted by said magnetized element on the magnetic developer particles located a distance from the recording surface greater than the predetermined thickness is greater than the force exerted on such magnetic developer particles by the magnetized zones.

* * * * *

UNITED STATES PATENT AND TRADEMARK OFFICE

CERTIFICATE OF CORRECTION

PATENT NO. : 4,610,527

DATED : September 9, 1986

INVENTOR(S) : Cherbuy et al

It is certified that error appears in the above-identified patent and that said Letters Patent is hereby corrected as shown below:

Column 9, line 51 (claim 3) "part" should be --second location--.
Column 10, line 7 (claim 7) delete "element".
Column 10, line 63 (claim 19) delete "element".

Signed and Sealed this

Sixth Day of January, 1987

*Attest:*

DONALD J. QUIGG

*Attesting Officer*

*Commissioner of Patents and Trademarks*